US012668985B2

(12) United States Patent
Tian et al.

(10) Patent No.: US 12,668,985 B2
(45) Date of Patent: Jun. 30, 2026

(54) DIRECTION-ADJUSTABLE BOLTED SPHERICAL JOINT FOR COLLAPSE RESISTANCE AND EARTHQUAKE RESISTANCE

(71) Applicant: Xi'an University of Architecture and Technology, Xi'an (CN)

(72) Inventors: Limin Tian, Xi'an (CN); Yuefeng Kou, Xi'an (CN)

(73) Assignee: Xi'an University of Architecture and Technology, Xi'an (CN)

( * ) Notice: Subject to any disclaimer, the term of this patent is extended or adjusted under 35 U.S.C. 154(b) by 192 days.

(21) Appl. No.: 18/650,089

(22) Filed: Apr. 30, 2024

(65) Prior Publication Data

US 2025/0154788 A1 May 15, 2025

(30) Foreign Application Priority Data

Nov. 9, 2023 (CN) ..... 202311485975.3

(51) Int. Cl.
*E04H 9/02* (2006.01)

(52) U.S. Cl.
CPC ..... *E04H 9/021* (2013.01)

(58) Field of Classification Search
CPC ..... E04H 9/021; E04B 1/1906; E04B 1/1903; E04B 1/19; E04B 1/343; E04B 1/58; E04B 1/92; E04B 1/98; F16B 7/185; A47B 47/0008; Y10T 403/342; Y10T 403/347

See application file for complete search history.

(56) References Cited

U.S. PATENT DOCUMENTS

| | | | | | |
|---|---|---|---|---|---|
| 4,766,712 | A * | 8/1988 | Hale | E04B 1/1903 | 52/645 |
| 5,088,852 | A * | 2/1992 | Davister | F16B 7/044 | 403/171 |
| 8,820,025 | B1 * | 9/2014 | Rochas | E04B 1/1906 | 52/81.3 |

FOREIGN PATENT DOCUMENTS

| | | | | | |
|---|---|---|---|---|---|
| AT | 397531 | B * | 4/1994 | E04B 1/1906 | |
| CA | 2029156 | C * | 1/1993 | E04B 1/1906 | |
| CN | 210067070 | U | 2/2020 | | |
| CN | 221441737 | U | 7/2024 | | |
| DE | 4009371 | A1 * | 9/1991 | E04B 1/1906 | |
| DE | 4444272 | A1 * | 6/1996 | E04B 1/1906 | |
| EP | 0265981 | A1 * | 5/1988 | E04B 1/1906 | |
| EP | 0557234 | A1 * | 8/1993 | E04B 1/1903 | |
| ES | 2362845 | A1 * | 7/2011 | E04B 1/1906 | |
| FR | 2679577 | A1 * | 1/1993 | E02B 3/06 | |

(Continued)

*Primary Examiner* — Theodore V Adamos

(57) ABSTRACT

Provided is a direction-adjustable bolted spherical joint for collapse resistance and earthquake resistance. The joint includes a connecting component, disposed between a bolt ball and a member. The connecting component includes a threaded barrel, the threaded barrel is screwed into a connecting hole on the bolt ball, a connecting rod is clamped into the threaded barrel, a threaded cap is screwed onto the connecting rod, and an end of the threaded cap facing towards the threaded barrel is embedded into the threaded barrel. The connecting rod includes a ball head, the ball head is abutted against an end of the threaded barrel disposed in the bolt ball, the ball head is fixedly connected to a rod body, the rod body is disposed to pass through the threaded barrel and extend out of the bolt ball, and the threaded cap is screwed onto the rod body.

9 Claims, 3 Drawing Sheets

(56) References Cited

FOREIGN PATENT DOCUMENTS

GB 2197417 A * 5/1988 ..... E04B 1/1906

* cited by examiner

DIRECTION-ADJUSTABLE BOLTED SPHERICAL JOINT FOR COLLAPSE RESISTANCE AND EARTHQUAKE RESISTANCE

CROSS-REFERENCE TO RELATED APPLICATION

This application claims priority to a Chinese patent application No. CN202311485975.3, filed to China National Intellectual Property Administration (CNIPA) on Nov. 9, 2023, which is herein incorporated by reference in its entirety.

TECHNICAL FIELD

The disclosure relates to the technical field of earthquake-resistant structures, particularly to a direction-adjustable bolted spherical joint for collapse resistance and earthquake resistance.

BACKGROUND

A spatial grid structure has become a promising spatial structure owing to its reasonable stress, economical materials, beautiful and diverse shapes and covering a large space. Joints are key components of the spatial grid structure. A bolted spherical joint is widely used in the spatial grid structure because of its advantages of convenient and fast field installation, short construction period, and high installation efficiency.

However, due to lower redundancy of the spatial grid structure, the failure of the joint is likely to lead to continuous collapse of a corresponding whole structure. In the earthquake, the failure of the joint is mainly caused by low-cycle fatigue cumulative damage, and seismic performance of the whole structure is also closely related to energy dissipation capacity of the joint. In addition, due to the influence of machining accuracy, an existing bolted spherical joint member is not coaxial with a bolt ball, which leads to the difficulty of on-site installation, and the forced installation thereof is easy to cause an internal stress in the structure, which makes an actual working condition of the structure inconsistent with the design.

Therefore, the disclosure proposes a direction-adjustable bolted spherical joint for collapse resistance and earthquake resistance to solve the above technical problems.

SUMMARY

In order to solve the above technical problems, the disclosure provides a direction-adjustable bolted spherical joint for collapse resistance and earthquake resistance.

In order to achieve the above objectives, the disclosure provides a direction-adjustable bolted spherical joint for collapse resistance and earthquake resistance, which includes a connecting component, disposed between a bolt ball and a member. The connecting component includes a threaded barrel, the threaded barrel is screwed into a connecting hole on the bolt ball, a connecting rod penetrates into the threaded barrel and is clamped into the threaded barrel, a threaded cap is screwed onto the connecting rod, and an end of the threaded cap facing towards the threaded barrel is embedded into the threaded barrel and is abutted against an end of the threaded barrel facing away from the bolt ball. The connecting rod includes a ball head, the ball head is abutted against an end of the threaded barrel disposed in the bolt ball, the ball head is fixedly connected to a rod body, the rod body is disposed to pass through the threaded barrel and extend out of the bolt ball, and the threaded cap is screwed onto the rod body.

In an embodiment, the threaded barrel includes a barrel body, the barrel body is disposed in the connecting hole and is crewed into the bolt ball, the ball head is abutted against an end of the barrel body disposed in the bolt ball, another end of the barrel body is disposed to extend out of the connecting hole and is fixedly connected to a connecting barrel, and the connecting barrel is abutted against the bolt ball.

In an embodiment, the rod body is fixedly connected to a shear section, the shear section is disposed on the rod body, a shear part is disposed in the connecting barrel, an inner diameter of the shear part is smaller than an outer diameter of the shear section, and the shear section is abutted against the shear part; and the shear section is configured for abutting against the shear part when the rod body is pulled in a direction facing away the bolt ball.

In an embodiment, the end of the barrel body disposed in the bolt ball defines a first positioning groove, and the ball head is abutted against the end of the barrel body disposed in the bolt ball and is disposed in the first positioning groove.

In an embodiment, an end of the connecting barrel facing towards the threaded cap defines a second positioning groove, an end of the threaded cap facing towards the connecting barrel is provided with a positioning head adapted to the second positioning groove, and the positioning head is clamped in the second positioning groove.

In an embodiment, the first positioning groove and the second positioning groove are spherical in shape.

In an embodiment, the rod body is fixedly connected to a threaded section, the threaded section is disposed on the rod body, and the threaded cap is screwed onto the threaded section.

In an embodiment, an inner diameter of the barrel body is smaller than an outer diameter of the ball head, and the inner diameter of the barrel body is larger than the outer diameter of the shear section.

Compared with the related art, the disclosure has at least the following advantages and technical effects. When the direction-adjustable bolted spherical joint for collapse resistance and earthquake resistance is used, the connecting rod is inserted into the threaded barrel, the connecting rod inserted into the threaded barrel is connected into the bolt ball, and the threaded cap is screwed onto the connecting rod to make the threaded cap abut against the end of the threaded barrel. As such, the threaded barrel realizes tensile capacity between the connecting rod and the bolt ball; the threaded cap realizes compression resistance of the connecting rod, increases locking strength of the direction-adjustable bolted spherical joint, and realizes the collapse resistance and earthquake resistance of the bolt ball; and the ball head at the end of the connecting rod abutting against the threaded barrel prevents the connecting rod from being pulled out, thereby realizing the tensile function.

The disclosure is simple in structure and convenient to use, realizes the functions of collapse resistance, earthquake resistance and adjustable direction on the basis of not affecting the original design of the bolt ball, and is convenient to popularize.

BRIEF DESCRIPTION OF DRAWINGS

Accompanying drawings, which constitute a part of the disclosure, are used to provide a further understanding of the disclosure. Illustrative embodiments of the disclosure and their descriptions are used to explain the disclosure, and do not constitute an improper limitation of the disclosure.

REFERENCE NUMERALS

1. Bolt ball; 2. Connecting rod; 3. Threaded barrel; 4. Threaded cap; 5. Member; 11. Connecting hole; 21. Ball head; 22. Rod body; 23. Shear section; 24. Threaded section; 31. Barrel body; 32. Connecting barrel; 33. Shear part; 34. First positioning groove; 35. Second positioning groove; 41. Positioning head.

DETAILED DESCRIPTION OF EMBODIMENTS

Technical solutions of embodiments of the disclosure will be clearly and completely described herein with reference to the accompanying drawings. Apparently, the described embodiments are only parts of the embodiment of the disclosure, but not the whole embodiments. Based on the described embodiments in the disclosure, all other embodiments obtained by ordinary technicians in the field without creative labor belong to the scope of protection of the disclosure.

In order to make the above objectives, features and advantages of the disclosure more clearly and easy to understand, the disclosure will be further described in detail with the accompanying drawings and specific embodiments.

Figure 1:
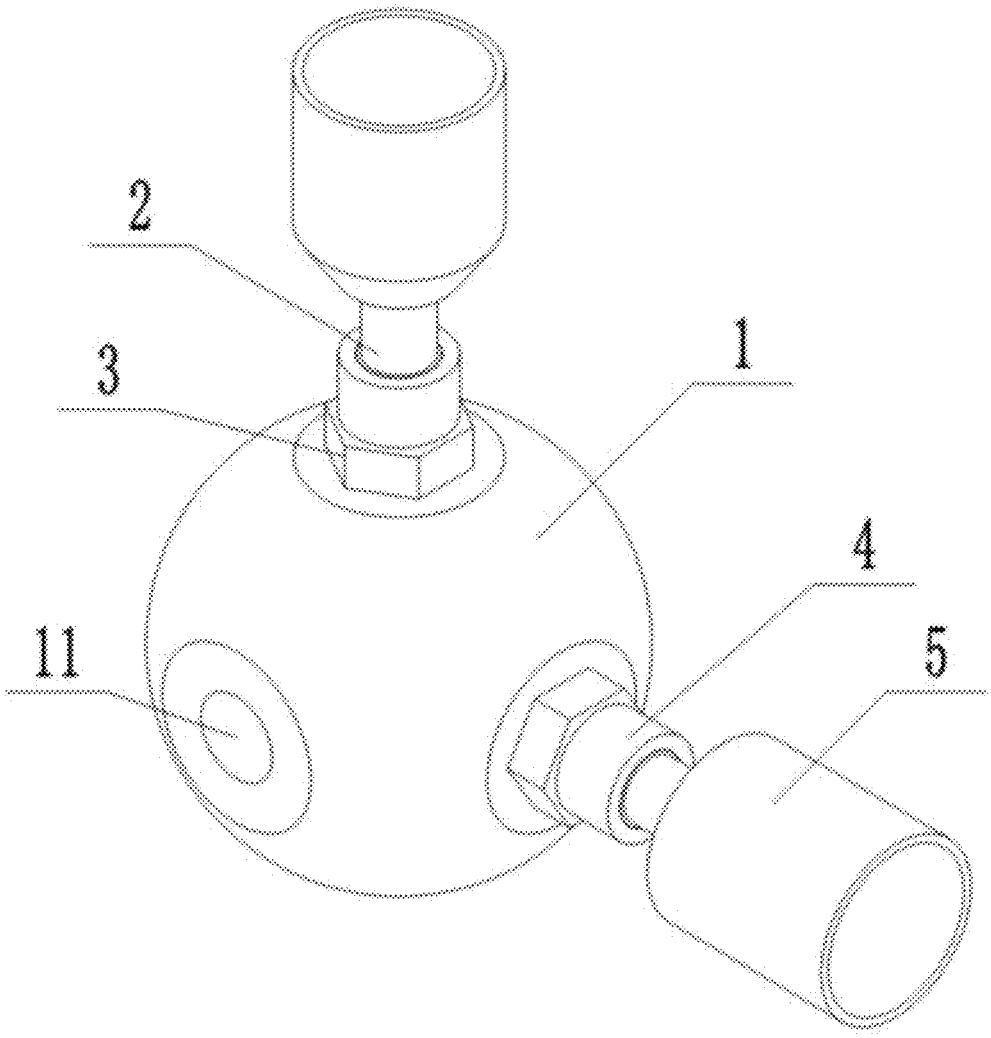
FIG. 1 illustrates a perspective view of a direction-adjustable bolted spherical joint for collapse resistance and earthquake resistance according to an embodiment of the disclosure.
Figure 2:
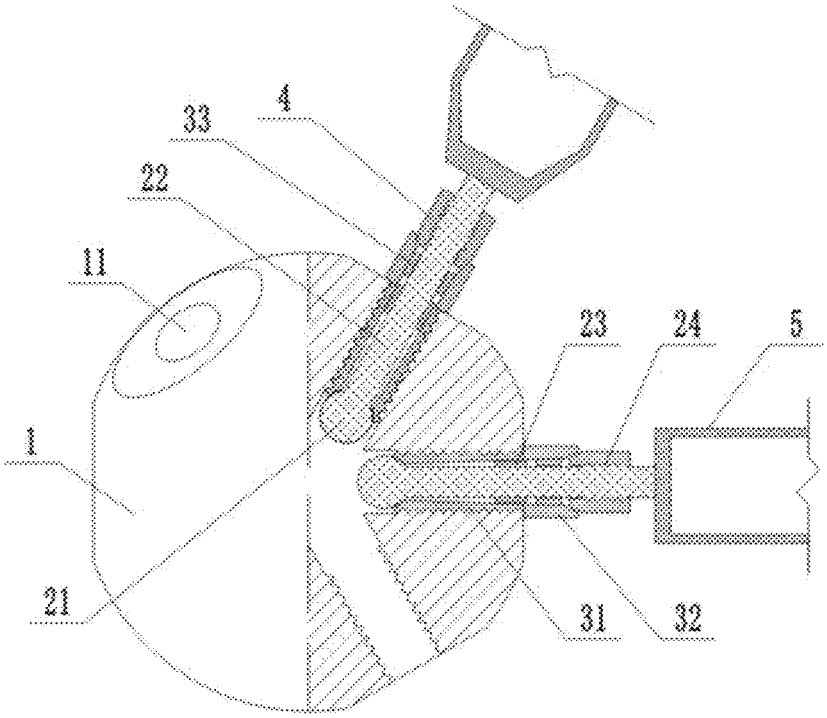
FIG. 2 illustrates is a schematic structural view of the direction-adjustable bolted spherical joint for collapse resistance and earthquake resistance according to the embodiment of the disclosure.
Figure 3:
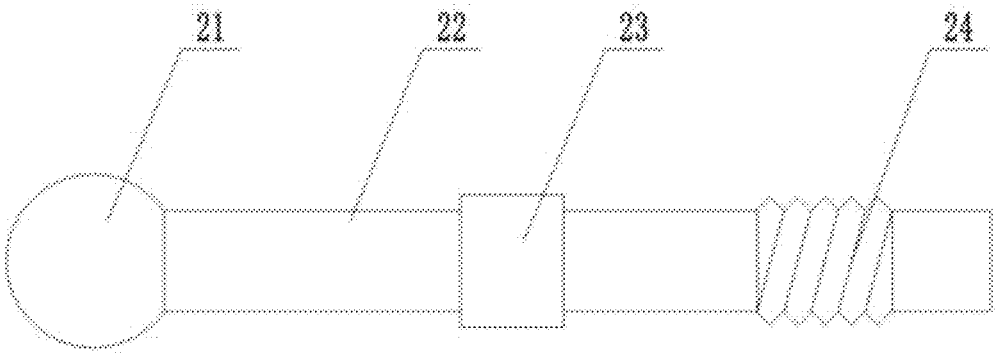
FIG. 3 illustrates a schematic structural view of a connecting rod of the direction-adjustable bolted spherical joint for collapse resistance and earthquake resistance according to the embodiment of the disclosure.
Figure 4:
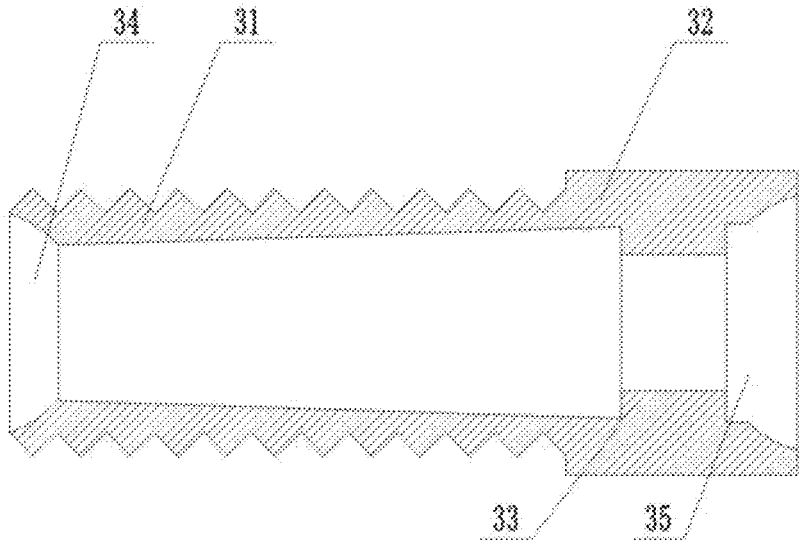
FIG. 4 illustrates a schematic structural view of a threaded barrel of the direction-adjustable bolted spherical joint for collapse resistance and earthquake resistance according to the embodiment of the disclosure.
Figure 5:
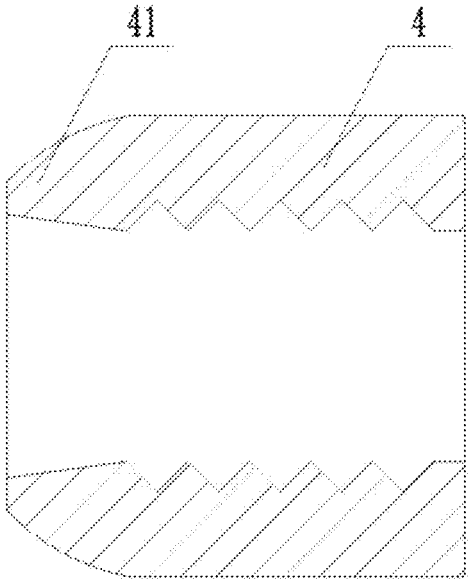
FIG. 5 illustrates a schematic structural view of a threaded cap of the direction-adjustable bolted spherical joint for collapse resistance and earthquake resistance according to the embodiment of the disclosure.

As illustrated in FIG. 1 through FIG. 5, a direction-adjustable bolted spherical joint for collapse resistance and earthquake resistance is provided according to an embodiment of the disclosure, which includes a connecting component disposed between a bolt ball 1 and a member 5.

Specifically, in an embodiment, the connecting component includes a threaded barrel 3, which is screwed into a connecting hole 11 on the bolt ball 1. A connecting rod 2 penetrates into in the threaded barrel 3 and is clamped into the threaded barrel 3. A threaded cap 4 is screwed onto the connecting rod 2, and an end of the threaded cap 4 facing towards the threaded barrel 3 is embedded into the threaded barrel 3 and is abutted against an end of the threaded barrel 3. The connecting rod 2 includes a ball head 21 disposed in the bolt ball 1, the ball heads 21 is abutted against an end of the threaded barrel 3 disposed in the bolt ball 1, the ball head 21 is fixedly connected to a rod body 22, and the rod body 22 is disposed to pass through the threaded barrel 3 and extend out of the bolt ball 1. The threaded cap 4 is screwed onto the rod body 22.

For the direction-adjustable bolted spherical joint for collapse resistance and earthquake resistance disclosed in the disclosure, when the direction-adjustable bolted spherical joint for collapse resistance and earthquake resistance is used, the connecting rod 2 is inserted into the threaded barrel 3, the connecting rod 2 inserted into the threaded barrel 3 is connected into the bolt ball 1, and the threaded cap 4 is screwed onto the connecting rod 2 to make the threaded cap 4 abut against the end of the threaded barrel 3. As such, the threaded barrel 3 realizes tensile capacity between the connecting rod 2 and the bolt ball 1; the threaded cap 4 realizes compression resistance of the connecting rod 2, increases locking strength of the direction-adjustable bolted spherical joint, and realizes the collapse resistance and earthquake resistance of the bolt ball 1; and the ball head 21 at the end of the connecting rod 2 abutting against the threaded barrel 3 prevents the connecting rod 2 from being pulled out, thereby realizing the tensile function.

In an illustrated embodiment, the threaded barrel 3 includes a barrel body 31, which is disposed in the connecting hole 11 and is crewed into the bolt ball 1. The ball head 21 is disposed to abut against an end of the barrel body 31 disposed in the bolt ball 1, i.e., an end of the barrel body 31 facing away from the threaded cap 4. Another end of the barrel body 31 is disposed to extend out of the connecting hole 11 and is fixedly connected to a connecting barrel 32, and the connecting barrel 32 is disposed to abut against the bolt ball 1. As such, the ball head 21 abuts against the barrel body 31, thereby preventing the rod body 22 from being pulled out, and thus achieving tensile strength.

In an illustrated embodiment, the rod body 22 is fixedly connected to a shear section 23 disposed on the rod body 22, a shear part 33 is disposed in the connecting barrel 32, an inner diameter of the shear part 33 is smaller than an outer diameter of the shear section 23, and the shear section 23 and the shear part 33 define a gap therebetween. When the rod body 22 is pulled in a direction facing away from the bolt ball 1, the shear section abuts against the shear part 33. In order to realize the anti-collapse function, the shear section 23 is capable of being abutted against the shear part 33 close to an inner wall of the connecting barrel 32, to realize the secondary locking when an end of the connecting rod 2 is damaged, thereby achieving the anti-collapse purpose. The connecting rod 2 of the disclosure is abutted against the threaded barrel 3 through the ball head 21, so as to realize the earthquake resistance function and ensure the stress balance of the whole section of the connecting rod 2.

In an illustrated embodiment, the end of the barrel body 31 disposed in the bolt ball 1 defines a first positioning groove 34, and the ball head 21 is abutted against the end of the barrel body 31 disposed in the bolt ball 1 and is disposed in the first positioning groove 34. The first positioning groove 34 is matched with the ball head 21. When the ball head 21 bears tension, the ball head 21 abuts against the end of the barrel body 31 disposed in the bolt ball 1 through the first positioning groove 34 to prevent slipping.

In an illustrated embodiment, an end of the connecting barrel 32 facing towards the threaded cap 4 defines a second positioning groove 35, and an end of the threaded cap 4 facing towards the connecting barrel 32 is provided with a positioning head 41 adapted to the second positioning groove 35, and the positioning head 41 is clamped in the second positioning groove 35. The positioning head 41 is clamped in the second positioning groove 35 and abuts against the threaded barrel 3, thus realizing the compression resistance of the connecting rod 2. The arrangement of the second positioning groove 35 and the positioning head 41 facilitates the fixing of the connecting rod 2 and the threaded barrel 3, and the second positioning groove 35 and the positioning head 41 are reinforced by double nut locking.

In an illustrated embodiment, the connecting rod 2 is made of low-yield-point steel or a high-ductility composite metal material, which can realize the energy consumption and earthquake resistance of the whole section of the connecting rod 2 on the basis of meeting the bearing capacity; moreover, when the connecting rod 2 is deformed by tension, the shear section 23 and the shear part 33 abut against each other to achieve secondary locking.

In an illustrated embodiment, both the first positioning groove 34 and the second positioning groove 35 are disposed in a spherical shape. In order to achieve direction adjustable, a bearing surface of the threaded barrel 3 abutting against the end of the connecting rod 2 and is spherical, and an inner wall of the threaded barrel 3 is conical, so that the connecting rod 2 can rotate around the end in all directions and absorb energy.

In an illustrated embodiment, the rod body 22 is fixedly connected to a threaded section 24 disposed on the rod body 22, and the threaded cap 4 is screwed onto the threaded section 24. The threaded cap 4 is screwed onto the threaded section 24, therefore, the connection and fixation of the threaded cap 4 with the connecting rod 2 is achieved.

In an illustrated embodiment, an inner diameter of the barrel body 31 is smaller than an outer diameter of the ball head 21, and the inner diameter of the barrel body 31 is larger than the outer diameter of the shear section 23. Based on this arrangement, it is convenient for the ball head 21 to abut against the barrel body 31; also, it is convenient for the shear section 23 to enter the barrel body 31 and abut against the shear part 33.

In the description of the disclosure, it should be understood that azimuth or positional relationships indicated by terms such as "longitudinal," "lateral," "upper," "lower," "front," "rear," "left," "right," "vertical," "horizontal," "top," "bottom," "inner," and "outer" are based on azimuth or positional relationships illustrated in the accompanying drawings. The terms are only for convenience of describing the disclosure, and does not indicate or imply that the devices or elements which are referred to by the terms must have a specific orientation, be constructed and operate in a specific orientation, and therefore should not be construed as limiting the disclosure.

The above-described embodiments only describe exemplary implementations of the disclosure, and do not limit the scope of protection of the disclosure. Under the premise of not departing from the design spirit of the disclosure, various modifications and improvements made by ordinary technicians in the field to the technical solutions of the disclosure shall fall within the scope of protection determined by the claims of the disclosure.

What is claimed is:

1. A direction-adjustable bolted spherical joint for collapse resistance and earthquake resistance, comprising a connecting component, disposed between a bolt ball (1) and a member (5);

wherein the connecting component comprises a threaded barrel (3), the threaded barrel (3) is screwed into a connecting hole (11) on the bolt ball (1), a connecting rod (2) penetrates into the threaded barrel (3) and is clamped into the threaded barrel (3), a threaded cap (4) is screwed onto the connecting rod (2), and an end of the threaded cap (4) facing towards the threaded barrel (3) is embedded into the threaded barrel (3) and is abutted against an end of the threaded barrel (3) facing away from the bolt ball (1); and wherein the connecting rod (2) comprises a ball head (21), the ball head (21) is abutted against an end of the threaded barrel (3) disposed in the bolt ball (1), the ball head (21) is fixedly connected to a rod body (22), the rod body (22) is disposed to pass through the threaded barrel (3) and extend out of the bolt ball (1), and the threaded cap (4) is screwed onto the rod body (22).

2. The direction-adjustable bolted spherical joint for collapse resistance and earthquake resistance as claimed in claim 1, wherein the threaded barrel (3) comprises a barrel body (31), the barrel body (31) penetrates into the connecting hole (11) and is screwed into the bolt ball (1), the ball head (21) is abutted against an end of the barrel body (31) disposed in the bolt ball (1), another end of the barrel body (31) is disposed to extend out of the connecting hole (11) and is fixedly connected to a connecting barrel (32), and the connecting barrel (32) is abutted against the bolt ball (1).

3. The direction-adjustable bolted spherical joint for collapse resistance and earthquake resistance as claimed in claim 2, wherein the rod body (22) is fixedly connected to a shear section (23), the shear section (23) is disposed on the rod body (22), a shear part (33) is disposed in the connecting barrel (32), an inner diameter of the shear part (33) is smaller than an outer diameter of the shear section (23), and the shear section (23) is configured for abutting against the shear part (33) when the rod body (22) is pulled in a direction facing away the bolt ball (1).

4. The direction-adjustable bolted spherical joint for collapse resistance and earthquake resistance as claimed in claim 3, wherein an inner diameter of the barrel body (31) is smaller than an outer diameter of the ball head (21), and the inner diameter of the barrel body (31) is larger than the outer diameter of the shear section (23).

5. The direction-adjustable bolted spherical joint for collapse resistance and earthquake resistance as claimed in claim 2, wherein the end of the barrel body (31) disposed in the bolt ball (1) defines a first positioning groove (34), and the ball head (21) is abutted against the end of the barrel body (31) disposed in the bolt ball (1) and is disposed in the first positioning groove (34).

6. The direction-adjustable bolted spherical joint for collapse resistance and earthquake resistance as claimed in claim 5, wherein an end of the connecting barrel (32) facing towards the threaded cap (4) defines a second positioning groove (35), an end of the threaded cap (4) facing towards the connecting barrel (32) is provided with a positioning head (41) adapted to the second positioning groove (35), and the positioning head (41) is clamped in the second positioning groove (35).

7. The direction-adjustable bolted spherical joint for collapse resistance and earthquake resistance as claimed in claim 6, wherein the first positioning groove (34) and the second positioning groove (35) are spherical in shape.

8. The direction-adjustable bolted spherical joint for collapse resistance and earthquake resistance as claimed in claim 2, wherein the rod body (22) is fixedly connected to a threaded section (24), the threaded section (24) is disposed on the rod body (22), and the threaded cap (4) is screwed onto the threaded section (24).

9. A direction-adjustable bolted spherical joint for collapse resistance and earthquake resistance, comprising:

a bolt ball (1), wherein a connecting hole (11) is defined on the bolt ball (1);

a member (5); and a connecting component, connected between the bolt ball (1) and the member (5);

wherein the connecting component comprises:

a threaded barrel (3), screwed into the connecting hole (11);

a connecting rod (2), wherein the connecting rod (2) penetrates into the threaded barrel (3) and is clamped into the threaded barrel (3), the connecting rod (2) comprises a ball head (21) and a rod body (22), the ball head (21) is abutted against an end of the threaded barrel (3) disposed in the bolt ball (1), the ball head (21) is fixedly connected to the rod body (22), and the rod body (22) is disposed to pass through the threaded barrel (3) and extend out of the bolt ball (1) to connect to the member (5); and a threaded cap (4), wherein an end of the threaded cap (4) facing towards the threaded barrel (3) is embedded into the threaded barrel (3) and is abutted against an end of the threaded barrel (3) facing away from the bolt ball (1), and the threaded cap (4) is screwed onto the rod body (22).

* * * * *